US006601742B2

(12) United States Patent
Hickman

(10) Patent No.: US 6,601,742 B2
(45) Date of Patent: Aug. 5, 2003

(54) APPARATUS FOR QUICK ACCESS TO WEAPONRY

(76) Inventor: John Hickman, 6302 Valentine Rd., N. Little Rock, AR (US) 72117

( * ) Notice: Subject to any disclaimer, the term of this patent is extended or adjusted under 35 U.S.C. 154(b) by 0 days.

(21) Appl. No.: 09/888,138

(22) Filed: Jun. 22, 2001

(65) Prior Publication Data

US 2002/0195472 A1 Dec. 26, 2002

(51) Int. Cl.[7] ..... A45F 5/02; F41C 33/02; F41C 33/04

(52) U.S. Cl. ..... 224/149; 224/247; 224/913; 2/102; 2/249

(58) Field of Search ..... 224/195, 149, 224/913, 911, 912, 247; 42/94; 2/249, 102

(56) References Cited

U.S. PATENT DOCUMENTS

| | | | | | |
|---|---|---|---|---|---|
| 2,910,804 | A | * | 11/1959 | White | 2/300 |
| 3,187,967 | A | * | 6/1965 | Somple | 224/150 |
| 3,211,351 | A | * | 10/1965 | Somple | 224/150 |
| 3,258,182 | A | * | 6/1966 | McDonald | 224/254 |
| 3,289,903 | A | * | 12/1966 | Taormina | 224/244 |
| 3,501,074 | A | * | 3/1970 | Emerick | 224/246 |
| 3,700,147 | A | | 10/1972 | Vaughn | |
| 3,865,289 | A | | 2/1975 | Boren | |
| 3,869,074 | A | * | 3/1975 | Roach | 224/149 |
| 4,253,592 | A | | 3/1981 | Anderson | |
| 4,431,122 | A | * | 2/1984 | Garmong | 224/150 |
| 4,485,947 | A | * | 12/1984 | Cook | 224/243 |
| 4,580,707 | A | | 4/1986 | Shoemaker | |
| 4,895,285 | A | * | 1/1990 | Dunn | 2/94 |
| 5,009,022 | A | * | 4/1991 | McCoy | 42/106 |
| 5,058,788 | A | * | 10/1991 | Newmark | 224/198 |
| 5,513,785 | A | * | 5/1996 | Campagna, Jr. | 224/162 |
| 5,765,738 | A | * | 6/1998 | Hoffner | 224/661 |
| 5,784,821 | A | * | 7/1998 | Gerard | 42/15 |
| 5,937,558 | A | * | 8/1999 | Gerard | 42/15 |

* cited by examiner

*Primary Examiner*—Stephen P. Garbe
(74) *Attorney, Agent, or Firm*—Mark Murphey Henry

(57) ABSTRACT

A combination holster for weapons having a front stock and a butt-stock, comprising a front stock holster having interior and exterior portions, the interior portion mimicking the contour of the front stock, and a butt-stock retraction element connected to the user and to the butt stock. The retention element may be a cord connected to a vest. The weapon is secured in a first position in which the front stock holster grips the front-stock, and the retraction element retains the butt-stock near the user. The weapon may be unsecured by removing the front stock from its holster and applying a drawing force to the retention element to pull the butt-stock away from the user. To return the weapon to a secure position, the user returns the front stock its holster and permits the butt-stock retention element retain the butt-stock near the user.

2 Claims, 3 Drawing Sheets

APPARATUS FOR QUICK ACCESS TO WEAPONRY

CROSS REFERENCES

None.

GOVERNMENT RIGHTS

None.

BACKGROUND OF THE INVENTION

This invention relates to the field of weapons and tactical arms, and more particularly, to the need to quickly access a weapon from a holstered position to an active position. For example, usually in a police or tactical squad situation, the armed officer uses at least two weapons; (1) a handheld weapon such as a pistol that is holstered either at the user's waist or across his upper torso, and (2) a long weapon that is ordinarily carried with a traditional sling attached at two points on the long weapon. A shotgun is desirable because it is effective at close-range but is not traditionally effective at long range and this characteristic lessens the risk of injury to innocent by-standers.

Ordinary handheld weapon holsters seemingly satisfy the balance between reliable holstering and the user's need for quick access. It is only a relatively minor problem to re-holster the handheld weapon, depending upon the safety features associated with the holster such as additional security straps. However, large, unresolved problems occur when a user such as a police officer needs to quickly access a long weapon such as a shotgun or military-style rifle, and even larger problems occur when the user needs to re-holster the long weapon.

It is known in the field to use holsters in connection with small arms such as pistols. It is also known in the field to use a holster that is capable of adjusting alongside the belt as worn by the user to facilitate easy accessibility. For example, holsters that switch between a right-hand access and a left-hand access provide a moderate level of flexibility in holster design. The goal and utility of these prior holsters rests in the ease of withdrawal or un-holstering of the weapon.

It is also known in the field of tactical arms and police tactical accessories to use shotguns to minimize risk to potential third parties or innocent bystanders. It is less known in the industry to use holsters in connection with the long weapons such as shotguns. However, the few holsters known in the field are generally static, inflexible and are only minimally adaptable to situations where an officer or individual user must quickly access a weapon. The concept of ease of access has been a goal of holsters for weapons; however, this goal has not been reached for long, cumbersome weapons. More importantly, the goal of returning quickly any sized weapon to a safe holstered position has not been adequately addressed, until now.

Of the few static holsters that are available for long weapons, they generally consist of a cumbersome receiving clip for the front grip or barrel portion of the weapon. This receiving clip is generally connected to the user at the user's waist, and it is further used in conjunction with a complete wrap-around or wrap-over fastening material to fully secure the front-stock portion of the long weapon to the user's waist. Indeed, one primary goal of this traditional complete "wrap" system is to prevent release of the long weapon. Because the wrap system described above completely surrounds the front grip area or barrel portion of a long weapon, the butt-stock portion remains ignored. As an afterthought, the butt-stock ordinarily is retained around or near the user's upper torso by a traditional sling placed around the neck or upper torso of the user. Thus, the prior art concerning long weapons relates to and concerns either an inconvenient sling worn around the user's neck or a cumbersome wrap configuration, or both.

Because the dual sling and wrap configuration traditionally used with long weapons introduces two distinctly different variables into the user's access to the long weapon, any number of errors or complications may result; accordingly, the risk of using such combination may outweigh any benefit associated with carrying the weapon. However, the present invention addresses and resolves these issues, and more. The present invention can be used in conjunction with either handguns or with long weapons.

SUMMARY

It is therefore an object of the present invention to provide a method of quickly accessing a weapon such as a handgun, a shotgun or military style rifle whereby a user can move the weapon from a securely holstered position to a free position without complex or risky maneuvers. The present invention contemplates and facilitates a one-handed operation when either holstering, un-holstering, or re-holstering the weapon.

It is still further object of the present invention to provide a method to selectively or automatically retract the butt-stock portion of a weapon close to the body of the user when the weapon is not in active use, thereby minimizing the interference of the butt-stock with the user and facilitating a safe holstering of the weapon.

It is still further object of the present invention to provide a method that facilitates a complete retention system of a weapon on both the butt-stock portion and the front-stock portion, adding stability and security to a holstered weapon.

It is still further object of the present invention to provide a method of keeping a weapon in a holstered position so as to minimize or eliminate interference with movement of the user and to allow the user to have both hands free and unrestricted when a weapon is properly holstered and secured.

It is still further object of the present invention to provide a method of accessing a weapon from a holstered position to a free position without the requirement that the user change focus or divert attention from the overall task or mission underway.

It is still further object of the present invention to provide a method of securing a weapon near and convenient to other tactical items such as ammunition, bullet-proof gear, storage pockets, flashlights, and handcuffs, i.e., to facilitate a complete tactical package.

It is still further object of the present invention to provide a method of securing the front-stock portion of the weapon in a manner that is within comfortable reach of the user's dominant hand.

It is still further object of the present invention to provide a method of securing safely the front-stock portion of the weapon in a manner that contemplates one-hand operation yet prevents accidental release of the front-stock portion.

It is still further object of the present invention to provide a butt-stock retention apparatus that has intrinsic tendency to retract the butt-stock portion of the weapon towards and close to the body of the user.

It is still further object of the present invention to provide a front-stock holster apparatus that has intrinsic tendency to accept and substantially grip the front-stock portion of the weapon without the need for straps to keep the front-stock portion contained within the holster.

Towards the fulfillment of these and other objects and advantages, the present invention contemplates a method of securing a weapon in a first, holstered position whereby the butt-stock is connected to and secured near the body of the user with a retraction means, and whereby the front-stock is secured to the body of the user within a front-stock holster. The method further contemplates a user moving the weapon from a first, holstered position to a second, free position whereby the butt-stock is still retractably connected to the user but the front-stock is no longer secured in the front-stock holster. In this second step, the user may, without substantial restriction, utilize the weapon for tactical purposes, including sighting and firing the weapon. The method then contemplates a user returning the weapon back to a first, holstered position by returning the front-stock portion of the weapon back into the front-stock holster with one hand, and the retraction means selectively or automatically returning the butt-stock portion to a secured position near the body of the user.

The method described above further contemplates that the first step of securing the weapon will also comprise the front-stock holster being adaptably configured and molded to substantially envelope at least a portion of the exterior surface of the front-stock, in order to facilitate a suitable grip or retention of the front-stock within the front-stock holster.

The method described above further contemplates that the first step of securing the weapon will also comprise the butt-stock retraction means utilizing a retraction cord that is attached to the butt-stock portion of the weapon.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT

Figure 1:
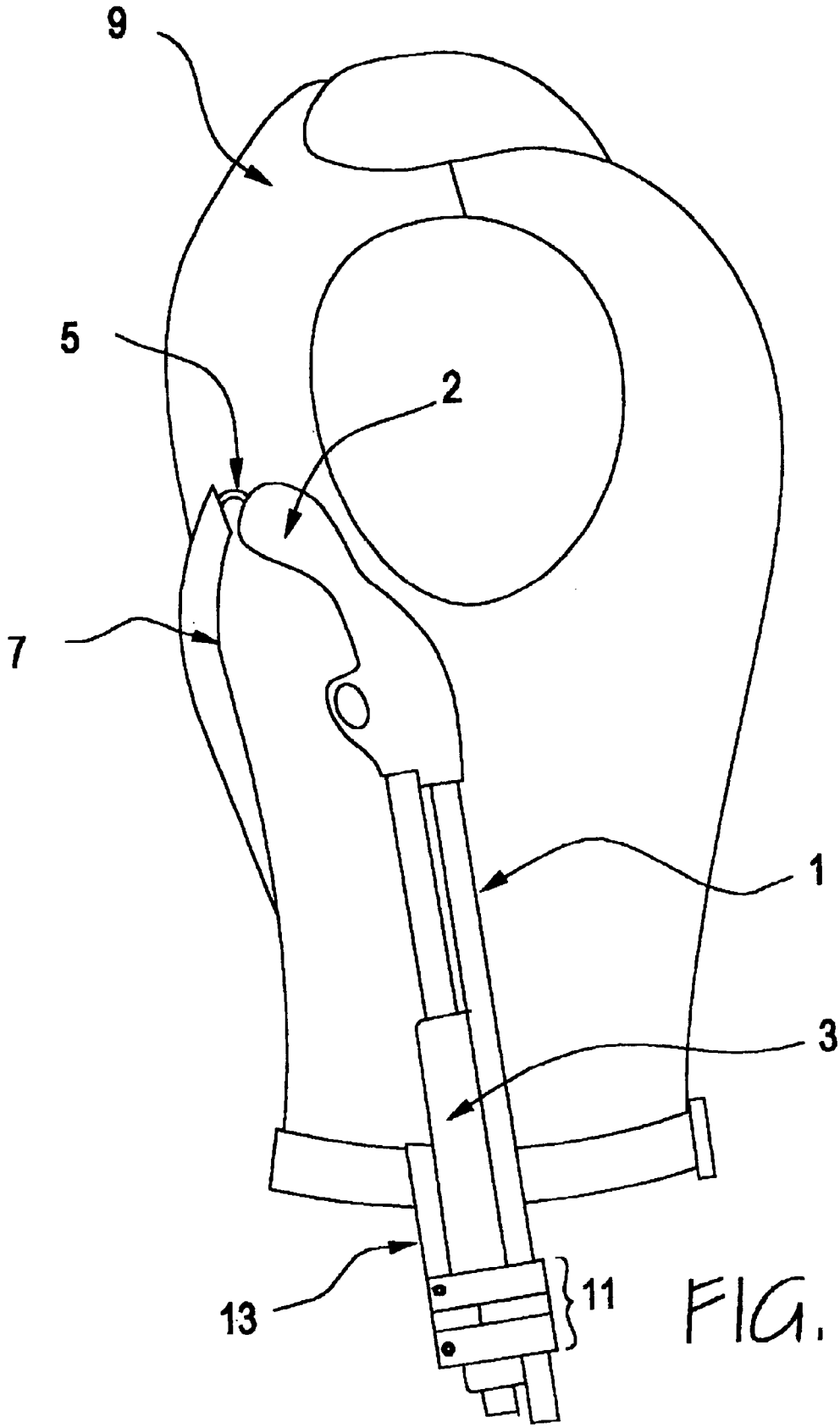
FIG. 1. is a perspective view that represents the first step whereby a long weapon is in a first, holstered position. In this figure, the weapon, 1, has a butt-stock, 2, and a front stock, 3. The butt-stock, 2, is connected to a retractable cord, 5, which is housed within a protective sleeve, 7. The protective sleeve, 7, is attached to a vest, 9. The front stock, 3, is secured within a front-stock holster, 11. The front-stock holster, 11, is secured to the body of the user with a belt attachment, 13. The front-stock, 3, is substantially surrounded by a front-stock holster, 11, and the weapon is secure in the first, holstered position.

In a first preferred embodiment, a user such as a police officer desires to use the method in connection with a long weapon such as a shotgun to minimize the range that a shot pellet will travel, and accordingly, decrease the risk that innocent bystanders will be injured by stray shot pellet. In this first preferred embodiment, a user begins at a first step, the holstered position, as is substantially illustrated and represented as FIG. 1.

To further illustrate the details of the first preferred embodiment, the user would place a long weapon is in a first, holstered position whereby the weapon, 1, has a butt-stock, 2, and a front stock, 3. The butt-stock, 2, is connected to a retractable cord, 5, which can be constructed of multi-ply elastic cording material. The retractable cord, 5, is housed within a protective sleeve, 7, to keep the multi-ply elastic cording material from becoming entangled with other objects and also to retain the integrity of the multi-ply elastic cording material. The protective sleeve, 7, is attached to a vest, 9, substantially along the back of the user such that the cord has a tendency to pull the butt-stock towards the under-arm region of the user. A benefit of this arrangement is that the butt-stock is readily accessible at all times to the user and is within easy reach. The front stock, 3, is secured within a front-stock holster, 11. The front-stock holster, 11, is secured to the body of the user with a belt attachment, 13. The front-stock, 3, is substantially surrounded by a front-stock holster, 11, by virtue of the corresponding mimic design of the front-stock holster in relation to the exterior shape of the front-stock. The front-stock holster, 11, has and the weapon is secure in the first, holstered position.

Figure 2:
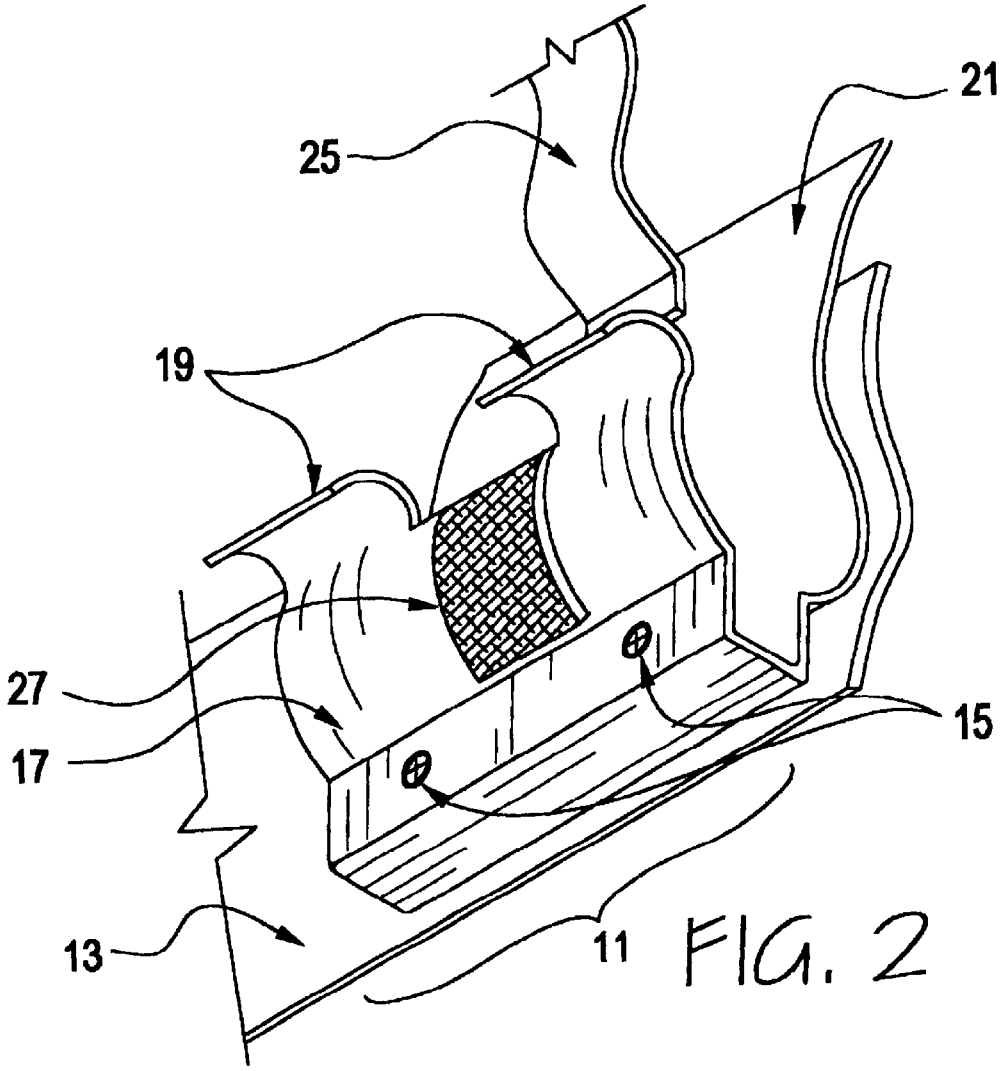
FIG. 2 is a perspective view of one embodiment available to the front-stock holster, 11, further depicting the belt attachment, 13, and one or more tension bolts, 15. The external side of the front-stock holster, 17, has one or more outwardly curved regions, 19, and the internal side of the front-stock holster, 21, is generally flanged toward the body of the user. The internal side of the front-stock holster, 21, has a retaining strap, 25, that connects to an attachment region, 27, located on the external side of the front-stock holster, 11.

FIG. 2 better illustrates the first preferred embodiment available to the front-stock holster, 11, which is connected to the user with a corresponding belt attachment. The front-stock holster is located a comfortable distance below the user's waist, to minimize unnecessary arm movement. The external side of the front-stock holster, 17, which is the side facing away from the leg of the user, has one or more outwardly curved regions, 19 to facilitate and permit the user to easily find and locate the front-stock holster without looking down or away from the mission underway. In this first preferred embodiment, the internal side of the front-stock holster, 21, which is the side facing towards the leg of the user, is generally flanged toward the body of the user. The internal side of the front-stock holster, 21, has a retaining strap, 25, that can be used to cover and thereby secure the front-stock at an attachment region, 27, located on the external side of the front-stock holster, 17. Generally, a retaining strap may use traditional hook-and-loop technology to secure the retaining strap, 25, to the attachment region, 27.

Figure 3:
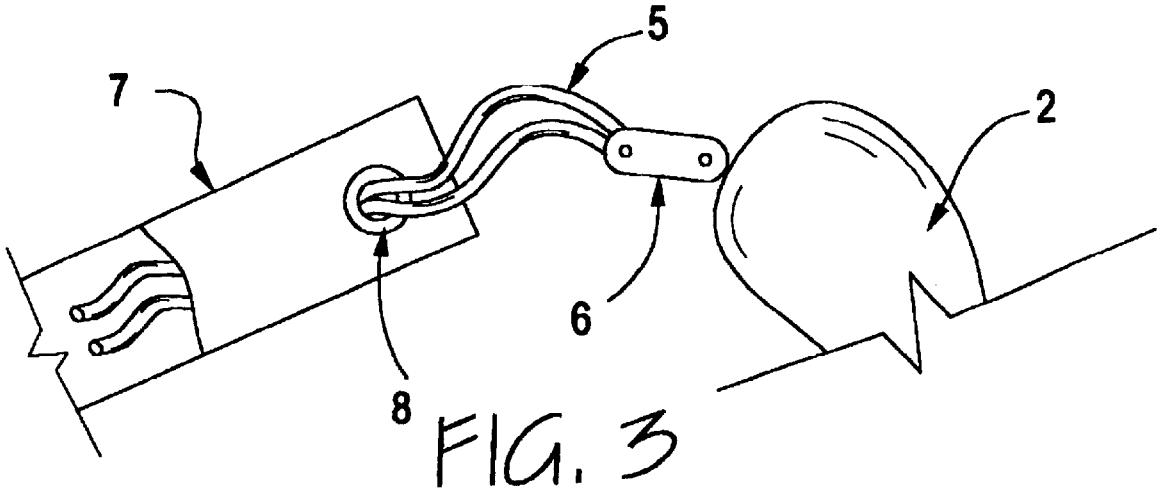
FIG. 3 is a perspective view of one embodiment available to the butt-stock retention means. In this figure, the butt-stock, 2, is connected to a retractable cord, 5, using a connection, 6. The retractable cord, 5, is shown in this figure as a plurality of cords. The retractable cord, 5, is housed within a protective sleeve, 7. The protective sleeve, 7, is shown with an opening, 8, through which the cord may retract and extend within the protective sleeve, 7.

FIG. 3 helps illustrate the first preferred embodiment available to the butt-stock retention means. In this figure, the butt-stock, 2, is connected to a retractable cord, 5, using a connection, 6. In many circumstances, the type of connection is immaterial; however, in this first preferred embodiment, the connection, 6, comprises a dual swivel to prevent the retractable cord, 5, from becoming twisted. The retractable cord, 5, is shown in this figure as a plurality of cords or in a multi-ply assembly. In many instances, it is desirable to use an external covering to properly assemble and maintain the plurality of cords or multi-ply cord assembly. The retractable cord, 5, is housed within a protective sleeve, 7. The protective sleeve, 7, is shown in FIG. 3 with an opening, 8, through which the cord may retract and extend within the protective sleeve, 7.

Figure 4:
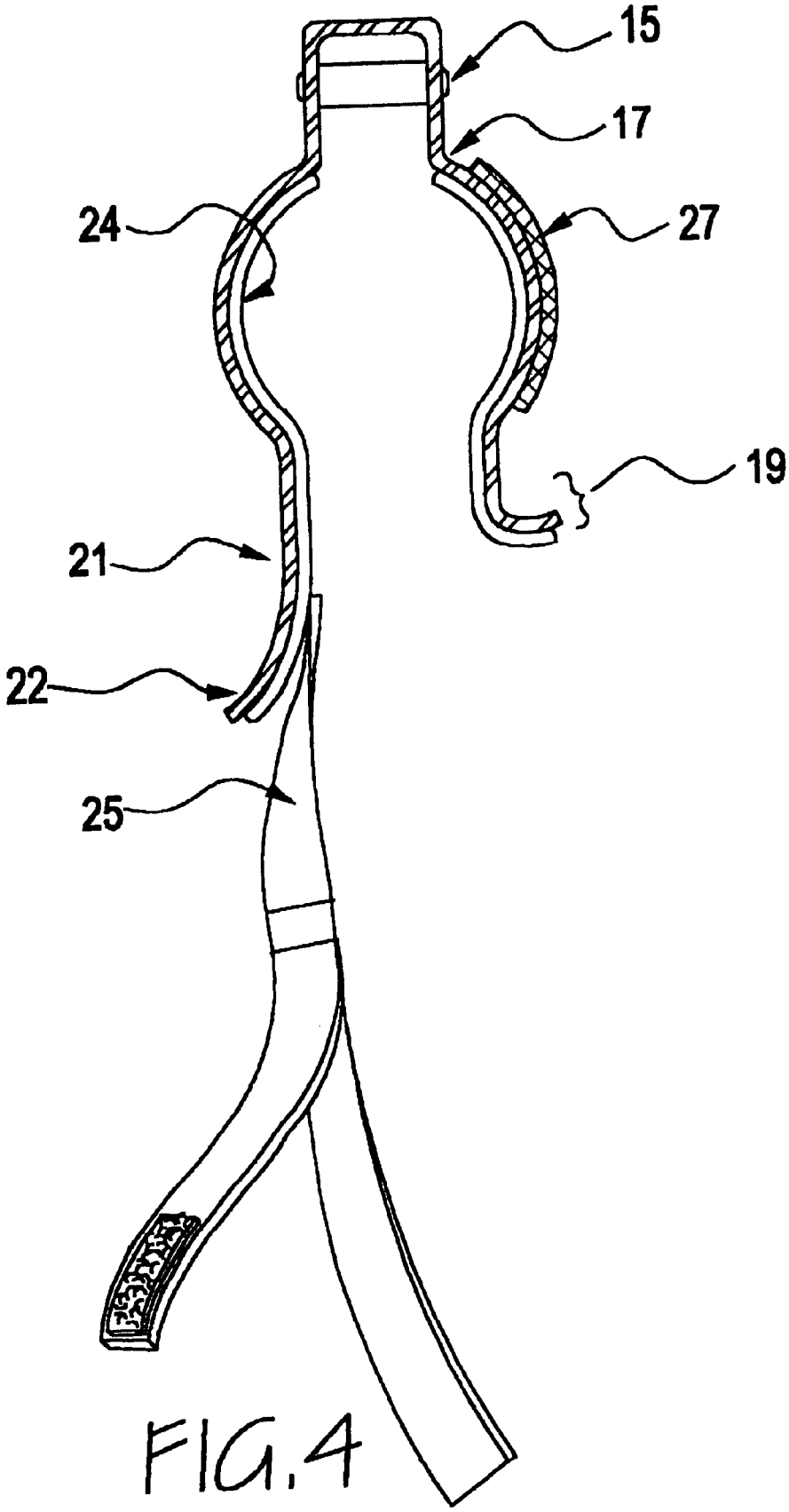
FIG. 4 is a cross-sectional view of the front-stock holster, 11, further depicting a tension bolt, 15. The external side of the front-stock holster, 17, has one or more outwardly curved regions, 19, and the internal side of the front-stock holster, 21, is generally flanged toward the body of the user, shown at 22. The interior portion of the front-stock holster, 24, is generally shaped to accept a semi-rounded front-stock portion of a weapon. The internal side of the front-stock holster, 21, has a retaining strap, 25, that connects to an attachment region, 27. The interior portion of the front-stock holster, 24, is further depicted to have a compressible gripping element.

In this first preferred embodiment, FIG. 4 represents a cross-sectional view of the front-stock holster, 11. It is apparent from FIG. 4 that the overall shape of the front-stock holster gains function from mimicking the overall relative shape of the front-stock such that the front-stock holster grips the front-stock substantially and conforms to the front-stock. The interior portion of the front-stock holster, 23, is generally shaped to accept a semi-rounded front-stock. To expand on this grip function, it has been useful to use a tension bolt, 15, to retain the gripping ability of the front-stock holster. While more than one tension bolt may be suitable to keep a grip on the front-stock, no set number is contemplated in this first preferred embodiment. To further expand on this grip function, the interior portion of the front-stock holster, 24, is further depicted to have a compressible gripping element. In this first preferred embodiment, the compressible gripping element comprises a soft rubber coating or an insertion of neoprene rubber material coated with a soft fabric.

The first preferred embodiment of the method further contemplates a user moving the weapon from a first, holstered position to a second, free position whereby the butt-stock is still retractably connected to the user but the front-stock is no longer secured in the front-stock holster. In this second step, the user may, without substantial restriction, utilize the weapon for tactical purposes, including sighting and firing the weapon.

To further illustrate the second step, the user may, without looking down, locate the front-stock holster by feeling for one or more outwardly curved regions, 19, on the external side of the front-stock holster, 17, with his right hand. Reference to the right hand is made not as a limitation but; instead, to properly illustrate the ease of operation of this method. The user would then remove, with the same right hand, the retaining strap, 25, from the attachment region, 27, which is located on the external side of the front-stock holster, 17. In this first preferred embodiment, the retaining strap employs traditional hook-and-loop technology, and this movement remains fluid, without complicating or distracting interruption.

Because the overall shape of the front-stock holster gains function from mimicking the overall relative shape of a generic front-stock such that the front-stock holster grips substantially the front-stock and conforms to the front-stock, the weapon remains holstered until the user decides to actively remove the weapon from the front-stock holster with his right hand. Even when the user removes the front-stock from the front-stock holster, the weapon is still attached to the user because the butt-stock, 2, remains connected to a retractable cord, 5, properly housed within a protective sleeve, 7, attached to the user with a vest, 9. The protective sleeve, 7, is shown in FIG. 3 with an opening, 8, through which the cord may suitably retract and extend within the protective sleeve, 7.

As a continuation of this second step, the user may grasp the front-stock area of the weapon with his right hand to remove the front-stock from the front-stock holster and also controllably extend the retraction cord thereby moving the butt-stock away from his body and away from the first, holstered position, to afford him opportunity to grasp the butt stock or a grip region with his left hand. This swift, fluid movement facilitates quick and unobstructed access to the weapon and further obviates the need for the user to switch hands to do a single operation.

As a third step to this first preferred embodiment, the user may elect to return the weapon to the first, holstered position by releasing his left hand grasp from the butt-stock or the grip region and controllably returning with his right hand the front-stock portion of the weapon back into the front-stock holster, thereby permitting the retraction cord to retract and return the butt-stock portion to a first, holstered and secured position near the body of the user. The user may leave the front-stock in the front-stock holster without the additional security of the retaining strap, 25, or the user may elect to secure the front-stock with his right hand by placing the retaining strap, 25, over the front-stock and connecting to the attachment region, 27, properly located in this first preferred embodiment between the one or more outwardly curved regions, 19, on the external side of the front-stock holster, 17.

In a second preferred embodiment, a user may elect to use the method in connection with smaller, handheld weapons. In this instance, the terms butt-stock and front-stock are used, not as terms of limitation, but merely as terms of reference. Typically, a traditional handheld weapon such as a pistol does not have a front-stock; however, it does have a front barrel portion that will be considered analogous or homologous to a front-stock and the front barrel portion will be referred to as a front-stock in this embodiment and for purposes of the present specification or claims. Also, the term butt-stock is applied to handheld weapons such as pistols to comprise the grip of a traditional pistol, but the term butt-stock will be used for purposes of the present specification or claims.

In the second preferred embodiment, the method contemplates a user moving the handheld weapon from a first, holstered position to a second, free position whereby the butt-stock is still retractably connected to the user but the front-stock is no longer secured in the front-stock holster. In this first step, the front-stock holster may comprise a traditional enveloping structure that covers substantially most of the front-stock region as is common to the industry, or it may comprise instead only a semi-enveloping structure that employs a magnet to substantially retain the position of the front-stock within or abutted next to, the front-stock holster.

In this second step, the user may, without substantial restriction, utilize the weapon for tactical purposes, including sighting and firing the weapon. However, in the second preferred embodiment, the user need only grasp the butt-stock of the handheld weapon to release or withdraw the front-stock from the front-stock holster and simultaneously or subsequently controllably extend the retraction cord thereby moving the butt-stock away from his body and away from the first, holstered position, to afford him opportunity to sight or fire the handheld weapon.

The method then contemplates a user returning the handheld weapon back to a first, holstered position by returning the front-stock portion of the weapon back into the front-stock holster with one hand, and the retraction means selectively or automatically returning the butt-stock portion to a secured position near the body of the user.

It is understood that there is a high degree of flexibility in the design of the retention means or retractable cord. The type of retractable cord, namely, the material used, is not the only element of flexibility in design. Importantly, the ability to selectively retract the butt-stock is specifically contemplated, either by use of a mechanical actuator or a voice-recognition or sound controlled system whereby the user would audibly or physically command the retraction means to selectively retract the weapon back to a holstered position, i.e., verbal command or push-button.

It is also understood that there is a high degree of flexibility in the design of the retraction cord connection to the butt-stock. This connection may be fixedly connected to the weapon or it may be releaseably connected to the weapon at the butt-stock region. While the drawings herein depict the connection occurring at the terminus of the butt-stock, this is for illustration only and is not intended as a limitation since the connection may suitably work in a variety of locations on the weapon, although, the principal advantage of the present invention is best achieved with the attachment or connection occurring in close proximity to the butt-stock or grip area.

It is also understood that there is a high degree of flexibility in the design of the front-stock holster. While a general effort to mimic and surround the outside shape and structure of the front-stock to facilitate adequate gripping is contemplated, the invention specifically contemplates designing front-stock holsters that substantially mirror certain weapon designs. Indeed, where the front-stock holster is used in connection with a handheld weapon, the front-stock holster will gain significant function in substantially mimicking the overall shape of the handheld weapon.

Use of magnetic elements to further enhance the gripping-ability of the front-stock holster to a front-stock is specifically contemplated. Indeed, use of this technology may reduce or alleviate the need for the front-stock holster to substantially envelope the front-stock. For example, the present invention specifically contemplates a front-stock holster that serves to retain the front-stock not through gripping and tension as is disclosed in the first preferred embodiment, but instead through magnetic attraction such that the front-stock holster may serve purely as a highly-magnetized place or area to secure the weapon instead of a traditional holster.

Other modifications, changes and substitutions are intended in the foregoing, and in some instances, some features of the invention will be employed without a corresponding use of the other features. For example, a retention means or retractable cord that is not attached to a vest is contemplated such that the retention means is used in connection with a holster strap otherwise fastened to the user's body, i.e., across the user's chest, back, waist, or leg.

In addition, it may not be necessary for a front stock retaining strap to be used, or it may prove beneficial to use retaining straps that offer a higher degree of security than does a traditional hook-and-loop fastening system.

The advantages to the present invention are discussed in previous sections; namely, that the present invention brings together the field of tactical arms and ease of use.

What is claimed is:

1. A combination holster for use with a gun having a front stock and a butt-stock, wherein the combination holster comprises:

a front stock holster having an interior cavity and an exterior, the interior cavity partly mimicking the contour of the front stock; and a butt-stock retraction means for biasing the butt-stock in a position adjacent the back of the body of the user, said retraction means having a first connection to the body of the user and a second connection to the butt stock; and, wherein the first connection to the body of the user further comprises a retractable cord housed within a protective sleeve attached to a vest.

2. A combination holster for use with a gun having a front stock and a butt-stock, wherein the combination holster comprises:

a front stock holster having an interior cavity and an exterior, the interior cavity partly mimicking the contour of the front stock; and a butt-stock retraction means for biasing the butt-stock in a position adjacent the back of the body of the user, said retraction means having a first connection to the body of the user and a second connection to the butt stock; and, wherein the first connection to the body of the user further comprises a retractable cord housed within a protective sleeve attached to a vest having one or more storage pockets.

* * * * *